United States Patent [19]

High, Jr. et al.

[11] Patent Number: 4,779,807

[45] Date of Patent: Oct. 25, 1988

[54] APPARATUS AND METHOD FOR SELECTING BETWEEN MULTIPLE FEED MATERIAL PROCESSING OPERATIONS

[75] Inventors: Samuel E. High, Jr., Lititz; Aquila D. Mast, Lancaster, both of Pa.

[73] Assignee: Feedmobile, Inc., Lititz, Pa.

[21] Appl. No.: 118,488

[22] Filed: Nov. 9, 1987

[51] Int. Cl.[4] ..... B02C 23/02

[52] U.S. Cl. ..... 241/24; 193/31 A; 241/30; 241/101 D; 241/101.2; 241/135; 241/186.3; 241/231

[58] Field of Search ..... 241/152 A, 100, 101 D, 241/101.2, 186.3, 135, 89.2, 231, 235, 230, 234, 24, 30; 193/31 R, 31 A

[56] References Cited

U.S. PATENT DOCUMENTS

| | | | |
|---|---|---|---|
| 459,075 | 9/1891 | Gray | 241/135 X |
| 465,134 | 12/1891 | Hobler et al. | 130/6 |
| 1,279,308 | 9/1918 | Emenegger et al. . | |
| 2,946,523 | 7/1960 | Phillips | 241/89.2 |
| 3,208,678 | 9/1965 | Pick et al. | 241/234 X |
| 3,396,767 | 8/1968 | Blanshine et al. | 241/236 |
| 3,399,839 | 9/1968 | Anderson et al. | 241/11 |
| 3,530,913 | 9/1970 | Kline et al. | 146/71 |
| 4,037,799 | 7/1977 | Urban | 241/136 |
| 4,053,112 | 10/1977 | Vander Hooven | 241/24 |
| 4,201,348 | 5/1980 | Bigbee et al. | 241/101 B |
| 4,608,007 | 8/1986 | Wood | 241/235 X |

*Primary Examiner*—Timothy V. Eley
*Assistant Examiner*—Joseph M. Gorski
*Attorney, Agent, or Firm*—Michael R. Swartz; John R. Flanagan

[57] ABSTRACT

The machine has an inlet, multiple processing mechanisms for performing multiple feed material processing operations and a discharge mechanism disposed in flow communication with discharge sides of the respective processing mechanisms. The processing mechanisms include a hammermill, a sheller, and a roller mill. The machine also includes apparatus for selecting between which of the mechanisms is to be used. The apparatus comprises first and second diverter structures. The first diverter structure at its infeed side is disposed in communication with the machine inlet and at its discharge side is disposed in communication with an infeed side of the hammermill. The second diverter structure at its infeed side is disposed in communication with the discharge side of the first diverter structure and at its discharge side is disposed in communication with respective infeed sides of the sheller and roller mill. The first diverter structure has a first gate selectively shiftable to either one of first or second displaced positions for respectively providing flow communication from the machine inlet to the hammermill or to the second diverter structure. The second diverter structure has a second gate selectively shiftable to either one of third or fourth displace positions for respectively providing flow communication from the discharge side of the first diverter structure to the sheller or to the roller mill. The hammermill and roller mill are adjustable to modify the feed material processing operations they can perform.

34 Claims, 8 Drawing Sheets

APPARATUS AND METHOD FOR SELECTING BETWEEN MULTIPLE FEED MATERIAL PROCESSING OPERATIONS

CROSS REFERENCE TO RELATED APPLICATIONS

Reference is hereby made to the following copending applications dealing with related subject matter and assigned to the assignee of the present invention:

1. "Whole Ear Corn Conversion Apparatus And Method" by Samuel E. High, Jr. et al, assigned U.S. Ser. No. 599,129 and filed Apr. 11, 1984.

2. "Whole Ear Corn Conversion Method Employing Breaking Of Whole Ears Before Shelling Kernels And Grinding Cobs" by Samuel E. High, Jr. et al, assigned U.S. Ser. No. 885,058 and filed July 14, 1986, a division of copending application Ser. No. 599,129 filed Apr. 1, 1984 this divisional application now issued as U.S. Pat. No. 4,744,523 on May 17, 1988.

BACKGROUND OF THE INVENTION

Field of the Invention

The present invention relates generally to processing of feed material and, more particularly, is concerned with an apparatus and method for selecting between multiple feed processing operations.

Description of the Prior Art

A variety of processing operations have been used over the years to convert basic feed materials, such as ear corn, corn kernels, husks, cobs, and grains of oats, into a more palatable and nutritional form for livestock feed. The processing operations range from operating a hammermill for grinding and pulverizing corn cobs to operating a roller mill for crimping and cracking small grains. Some processing operations have typically been employed together in tandem relation in the same machine. For instance, it is common practice to operate a sheller for first shelling corn ears to separate the kernels from the cobs and then operate a roller mill for rolling and cracking the kernels. Also, a hammermill can be provided in the machine for grinding and pulverizing the separated corn cobs.

Representative of the prior art are the machines of U.S. Pat. Nos. to Hobler et al (465,134), Blanshine et al (3,396,767), Kline et al (3,530,913), Urban (4,037,799), Vander Hooven et al (4,053,112) and Bigbee et al (4,201,348), and also the machine of the above cross-referenced copending applications assigned to the assignee of the present invention. One major drawback of most prior art machines is that they lack sufficient versatility. They cannot be adjusted to process a diverse range of different basic feed materials in different processing operations.

However, the ear corn conversion machine of the above cross-referenced application is a step in the right direction toward overcoming this drawback of prior art machines. It includes a single diverter structure having a gate or door pivotally mounted in a chute for selectively providing flow communication from a machine inlet to either a sheller or a hammermill. Nonetheless, the roller mill of this machine is located in tandem with the sheller. Therefore, crop material cannot be fed directly to the roller mill without first passing through the sheller. Thus, the machine does not accommodate a range of basic feed materials of the breadth desired.

Consequently, a need still remains for a more versatile approach to processing of basic feed material for livestock. The approach desired must be one that will accommodate a wider variety of feed materials and different processing operations.

SUMMARY OF THE INVENTION

The present invention provides an apparatus and method for selecting between livestock feed material processing operations, being designed to satisfy the aformentioned needs. The machine of the present invention incorporates features which provide the widest possible choices between the types of livestock feed material that can be processed and the types of processing operations that can be carried out. Also, features are included for adjusting processing operations to treat different feed materials in different manners.

Accordingly, the present invention is set forth in a machine having an inlet, multiple processing mechanisms for performing multiple feed material processing operations and a discharge mechanism disposed in flow communication with the processing mechanisms. The processing mechanisms include a hammermill for performing a grinding operation, a sheller for performing a separating operation and a roller mill for performing a rolling operation. The present invention is directed to an apparatus for selecting between the multiple feed material processing operations that comprises: (a) a first diverter structure which at an infeed side thereof is disposed in flow communication with the machine inlet and at a discharge side thereof is disposed in flow communication with an infeed side of the hammermill; and (b) a second diverter structure which at an infeed side thereof is disposed in flow communication with the discharge side of the first diverter structure and at a discharge side thereof is disposed in flow communication with respective infeed sides of the sheller and the roller mill.

More particularly, the first diverter structure has a first gate selectively shiftable to either one of first or second displaced positions for respectively providing flow communication through the first diverter structure from the machine inlet to the infeed side of the hammermill or to the infeed side of the second diverter structure. The second diverter structure has a second gate selectively shiftable to either one of third or fourth displaced positions for respectively providing flow communication through the second diverter structure from the discharge side of the first diverter structure to the infeed side of the sheller or to the infeed side of the roller mill.

Further, the first diverter structure includes a primary chute portion defining the machine inlet and a primary passage extending generally upstream of the first gate, and a pair of secondary chute portions connected to the primary chute portion and defining a pair of secondary passages branching in flow communication from the primary passage generally downstream of the first gate. The first gate is mounted for pivotal movement across the primary chute portion.

Also, the second diverter structure includes a pair of tertiary chute portions connected to one of the secondary chutes of the first diverter structure and defining a pair of tertiary passages branching in flow communication from the corresponding one of the secondary passages of the first diverter structure and extending generally downstream of the second gate. The one secondary passage extends generally upstream of the second gate.

The second gate is mounted for pivotal movement across the one secondary chute portion.

The hammermill includes a rotatable rotor cooperable with interchangeable screens which adapt the hammermill to produce processed feed material of different particle sizes. The roller mill includes a pair of rolls that are adjustable in their relative positions and a pair of variable speed hydraulic motors for adjusting the rotational speeds of the rolls to respectively set the spacing and speeds of the rolls for either cracking corn kernels or crimping grains of oats.

The present invention is also directed to a method of selecting between the multiple feed material processing operations that comprises the steps of: (a) providing flow communication from the machine inlet to an infeed side of a first diverter structure and from a discharge side of the first diverter structure to an infeed side of the hammermill; (b) providing flow communication from the discharge side of the first diverter structure to an infeed side of a second diverter structure and from a discharge side of the second diverter structure to respective infeed sides of the sheller and the roller mill; (c) selectively shifting a first gate of the first diverter structure to either one of first or second displaced positions for respectively providing flow communication through the first diverter structure from the machine inlet to the infeed side of the hammermill or to the infeed side of the second diverter structure; and (d) selectively shifting a second gate of the second diverter structure to either one of third or fourth displaced positions for respectively providing flow communication through the second diverter structure from the discharge of the first diverter structure to the infeed side of the sheller or to the infeed side of the roller mill.

These and other advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE PREFERRED EMBODIMENT

Figure 2:
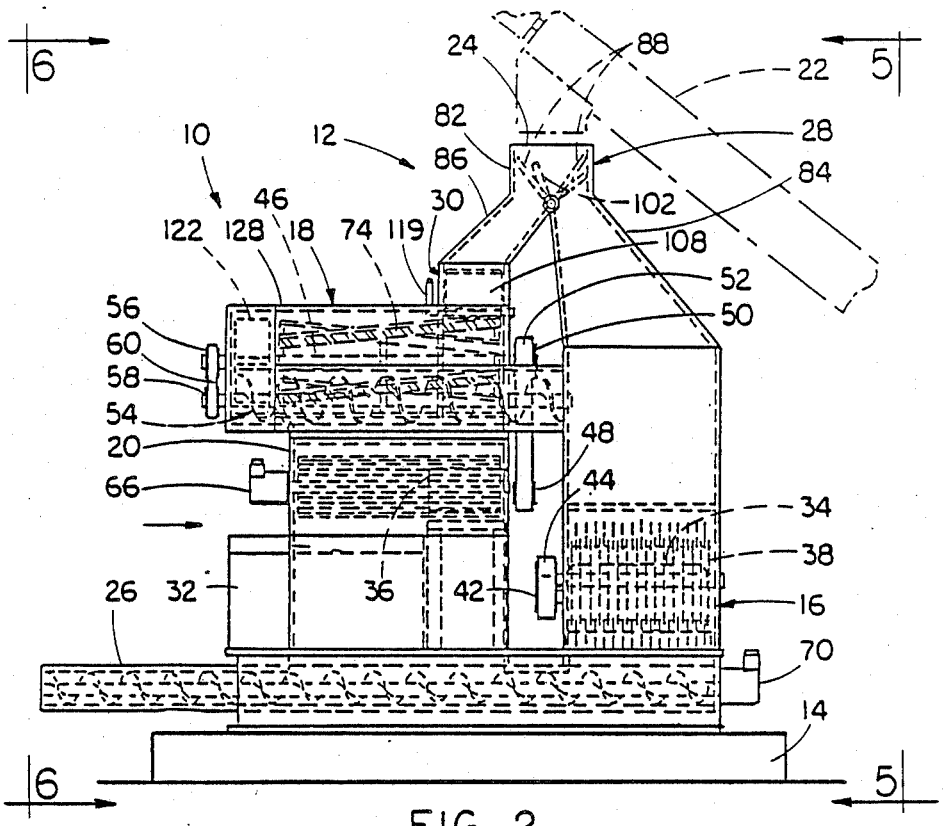
FIG. 2 is right side elevational view of a machine having an apparatus for selecting which of the multiple feed material processing operations will be performed by the machine.
Figure 3:
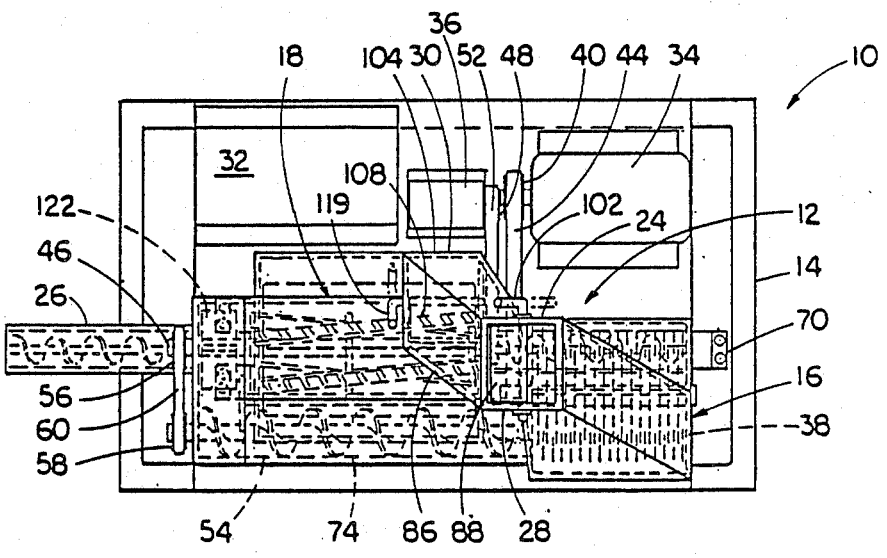
FIG. 3 is a top plan view of the machine of FIG. 2.
Figure 4:
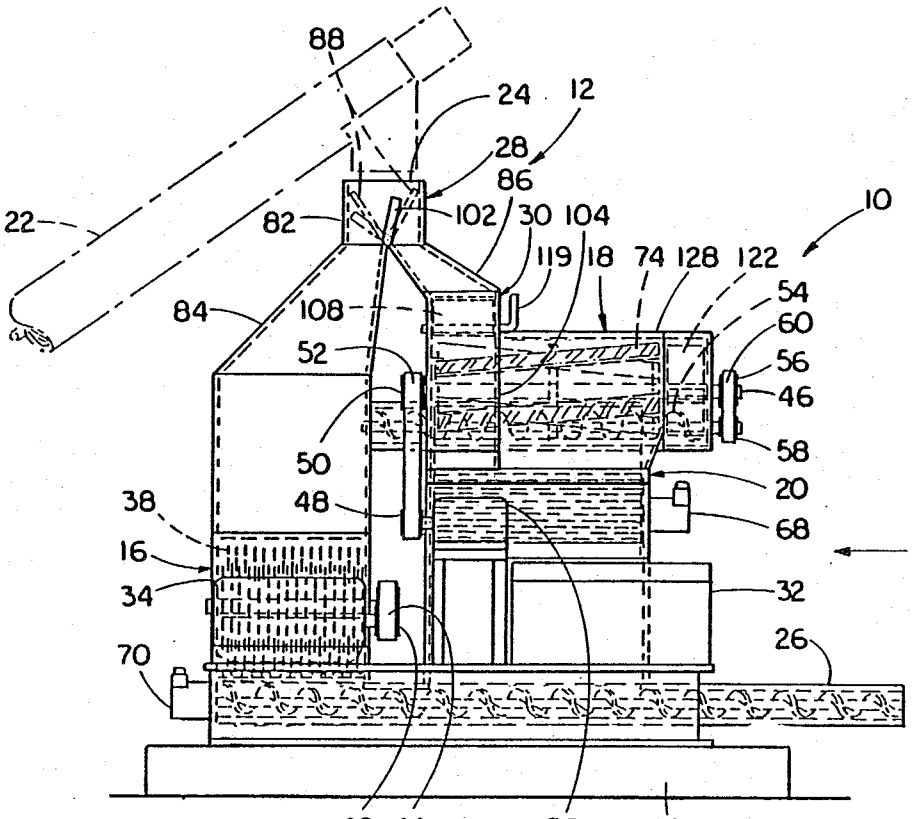
FIG. 4 is a left side elevational view of the machine of FIG. 2.
Figure 6:
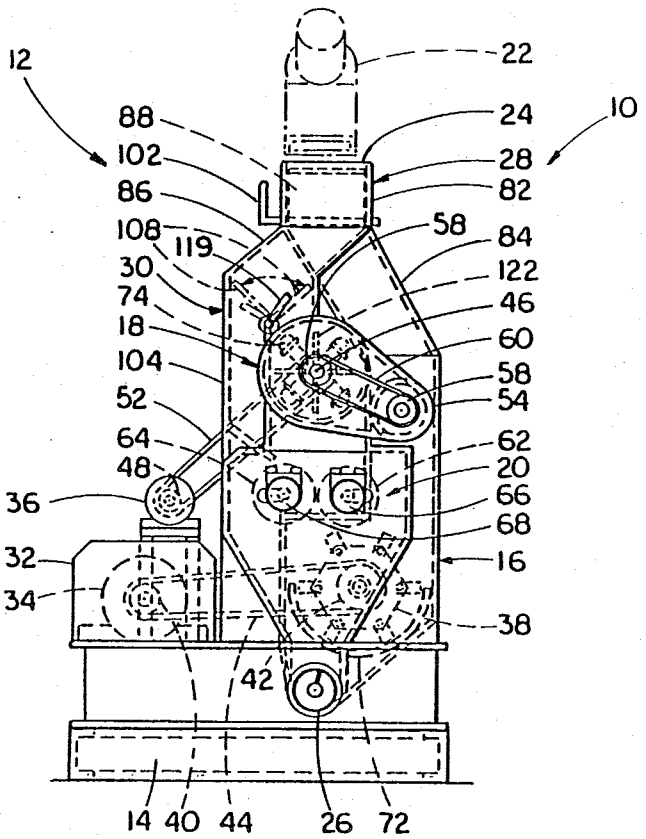
FIG. 6 is a rear end elevational view of the machine as seen along line 6—6 of FIG. 2.
Figure 5:
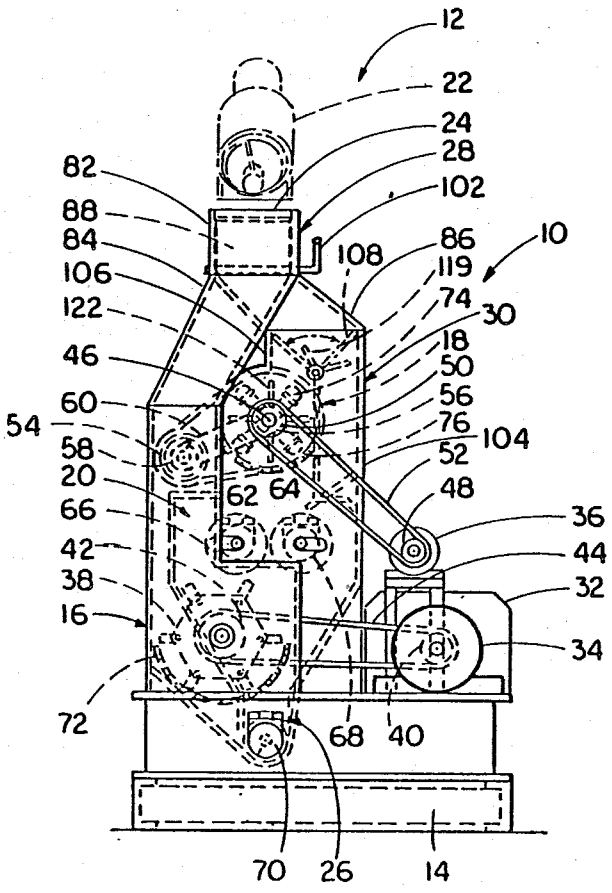
FIG. 5 is a front end elevational view of the machine as seen along line 5—5 of FIG. 2.

In the following description, right hand and left hand references are determined by standing at the rear of the machine and facing in the direction of arrow in FIG. 2. Also, in the following description, it is to be understood that such terms as "forward", "rearward", "left", "upwardly", etc., are words of convenience and not to be construed as limiting terms.

IN GENERAL

Figure 1:
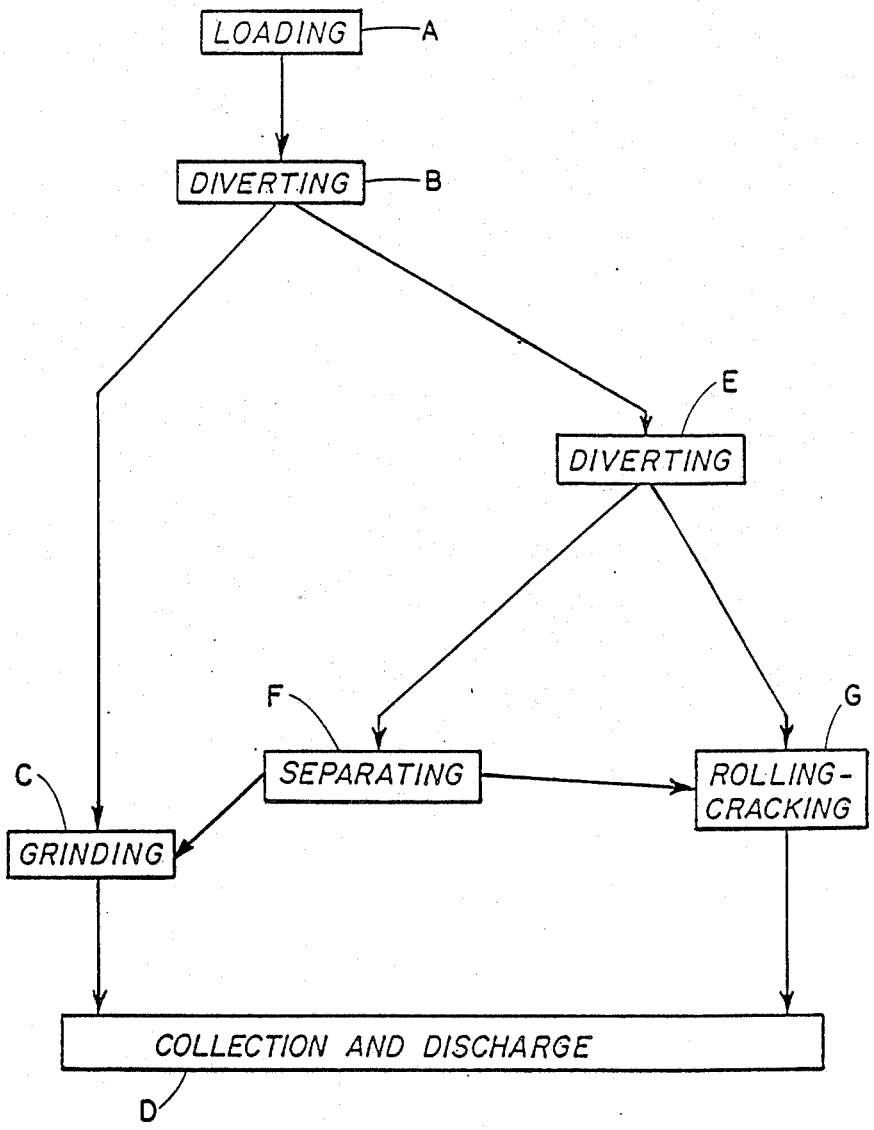
FIG. 1 is a flow chart depicting the possible paths which feed material can take with respect to the feed material processing operations carried out by multiple feed material processing mechanisms provided in a machine incorporating the method and apparatus of the present invention.

Referring now to the drawings, and particularly to FIGS. 1–6, there is shown in FIG. 1 a flow chart of the possible alternative paths which feed material can take through a multiplicity of feed material processing mechanisms in a machine, generally designated 10 in FIGS. 2–6, for converting basic feed material into a more nutritional and palatable form for livestock. The particular path the feed material takes depends upon selective actuation of the components of the diverting apparatus 12, which constitute some of the features of the present invention. The machine 10 is provided with a base 14 upon which its processing mechanisms are stationarily mounted for carrying out their feed material processing operations. However, it should be understood that, alternatively, the machine could be provided with a mobile chassis. The right and left sides of the machine 10 are shown respectively in FIGS. 2 and 4 when one is standing to the rear of the machine and facing in the direction of the arrows therein.

As shown in FIGS. 2–6, the multiplicity of feed material processing mechanisms of the machine 10 which cooperate together to perform multiple feed material processing operations are mounted on the stationary base 14. The operative processing mechanisms of the machine 10 include: a hammermill 16 for performing a grinding or pulverizing operation, a sheller 18 for performing a separating operation, and a roller mill 20 for performing a rolling-cracking operation. Other mechanisms of the machine 10 include a loader 22 for loading feed material into an inlet 24 of the machine 10 and a discharge mechanism in the form of an auger 26 disposed in flow communication with the hammermill 16, sheller 18 and roller mill 20 for performing an unloading operation. The diverting apparatus 12 includes first and second diverter structures 28, 30 which are used to select between which ones of the multiple feed material processing operations grinding, separating or rolling-cracking -- will be carried out at any given time.

As depicted in the flow diagram of FIG. 1, block A denotes loading of a feed material, such as corn ears, corn cobs, corn kernels, grains of oats, etc., into the inlet 24 of the machine 10 by operation of the infeed loader 22. The machine inlet 24 is connected in flow communication to an infeed side of the first diverter structure 28. Feed material is routed from the inlet 24 to the first diverter structure 28 where, as represented by block B, it can be selectively diverted from a discharge side thereof either left or right respectively to an infeed side of the hammermill 16 or of the second diverter structure 30.

As represented by block C, feed material diverted to the hammermill 16 is first reduced by a grinding operation and then passed to the discharge auger 26 where, as represented by block D, it is collected and discharged from the machine 10. On the other hand, feed material diverted to the second diverter structure 30 can be selectively diverted, as represented by block E, from a discharge side thereof either left or right respectively to an infeed side of the sheller 18 or the roller mill 20. As represented by blocks F and G, feed material routed to the sheller 18 undergoes a separating operation, whereas feed material routed to the roller mill 20 undergoes a rolling operation precedent to passing to the discharge auger 26. In the case of ear corn, shelled kernels then pass to the roller mill 20, whereas the cobs pass to the hammermill 16.

Cracking of corn kernels breaks them into desired size smaller pieces, but does not reduce them to powder form. Grinding of the cobs and stripped husks reduces them to a fine particle form. These cracked and ground components or parts of corn ears provides a more desirable particulate feed material which has higher nutritional value to livestock than that when they were in the whole corn ear form or condition. Rolling and cracking of grain such as corn kernels, and crimping of grain such as oats, makes the grain kernels more palatable by fracturing the outside hull of the kernel and letting the digestive juices of the livestock penetrate the softer parts of the kernel. The coarseness of the cracked and crimped kernels avoids compaction of the feed material and better assimilates the digestable nutrients of the grain. On the other hand, the fine ground cobs and husks combined with the rolled, cracked and crimped grains eliminates separation of the feed material components in a feed storage bin or silo and provides increased bulk in the feed ration.

DETAILS OF THE FEED MATERIAL PROCESSING MACHINE

As seen in FIGS. 2–6, the hammermill 16, sheller 18 and roller mill 20 are all supported by suitable frame structure (not shown) along the right half of the stationary base 14 of the machine 10. The space on the left half of the base 14 is occupied a hydraulic component housing 32 and respective first and second motors 34, 36 for powering the hammermill 16 and the sheller 18. The first motor 34 is drivingly coupled to a rotatable hammer-bearing rotor 38 of the hammermill 16 by a first drive train composed of a first pair of sheaves 40,42 mounted on the motor 34 and rotor 38 and a drive belt 44 extending between and entrained about the sheaves. The second motor 36 is drivingly coupled to a rotatable threshing bar-bearing shaft 46 of the sheller 18 by a second drive train composed of a second pair of sheaves 48,50 mounted on the motor 36 and shaft 46 and a drive belt 52 extending between and entrained about the sheaves. The shaft 46 at an opposite end is drivingly coupled to a transfer auger 54 by a third drive train composed of a third pair of sheaves 56,58 mounted on the shaft 46 and auger 54 and a drive belt 60 extending between and entrained about the sheaves. A pair of counterrotatable rolls 62,64 of the roller mill 20 are independently powered by respective hydraulic motors 66,68. Similarly, the discharge auger 26 is powered by its own hydraulic motor 70.

The grinding, separating and rolling operations are performed respectively by the hammermill 16, sheller 18 and rolling mill 20 in ways that are conventionally understood. In particular, the hammer-bearing rotor 38 of the hammermill 16 cooperates and coacts with a stationary perforated screen 72 therein to cause grinding, pulverizing or comminuting of the feed material fed into the hammermill. Also, a plurality of threshing bars 74 rotating with the shaft 46 of the sheller 18 cooperate and coact with a plurality of stationary vanes 76 therein to cause separation of the feed material, such as corn kernels from cobs, fed into the sheller 18. Further, the rolls 62,64 of the rolling mill 20 are mounted in side-by-side spaced apart relation so that their longitudinally-extending crimping elements or serrations 78,80 formed on the respective peripheries thereof cooperate and coact to cause crimping or cracking of grains, such as corn kernels or oats, fed into the rolling mill 20 between the rolls.

Several of the features of the present invention relate to the provision of the first and second diverter structures 28,30 of the diverting apparatus 12. The diverting apparatus 12 is used for choosing the one of the three processing mechanism on the machine 10 -- the hammermill 16, sheller 18 or roller mill 20 -- to which the feed material will be directly diverted or routed from the inlet 24 of the machine.

More particularly, the first diverter structure 28 at an infeed side thereof is provided in flow communication with the machine inlet 24 and at a discharge side thereof is provided in flow communication with an infeed side of the hammermill 16. The first diverter structure 28 includes an upstream primary chute portion 82, a pair of downstream secondary chute portions 84,86, and a first gate 88 disposed between the upstream and downstream chute portions 82 and 84,86. The primary chute portion 82 is generally rectangular shaped in cross section and defines the inlet 24 at its upper end. The primary chute portion 82 also defines a primary passage 90 extending generally upstream of the first gate 88. The pair of secondary chute portions 84,86 also rectangular in cross section are connected to the primary chute portion 82. The pair of secondary chute portions 84,86 define a respective pair of secondary passages 92,94 branching in flow communication from the primary passage 90 generally downstream of the first gate 88.

The first gate 88 of the first diverter structure 28 can be manually shifted selectively to either one of first or second displaced positions (respectively shown in solid and dashed line forms in FIG. 7) for respectively providing flow communication through the first diverter structure 28 from the inlet 24 to the infeed side of the hammermill 16 or to the infeed side of the second diverter structure 30. In particular, the first gate 88 is mounted for pivotal movement across the primary chute portion 82 to block one and open the other of the secondary passages 92,94 when pivotally moved to its first displaced position (seen in solid line form in FIG. 7) and to open the one and block the other of the secondary passages 92,94 when pivotally moved to its second displaced position (seen in dashed line form in FIG. 7).

The first gate 88 of the first diverter structure 28 includes a first rod-like shaft 96 rotatably mounted across the middle of the primary chute portion 82 between an opposing pair of the side walls 98 thereof adjacent to and between the secondary chute portions 84,86. Also, the first gate 88 includes a first plate-like flap 100 attached along the first shaft 96 and extending therefrom within the primary passage 90. The first shaft 96 has an upturned handle 102 fixed thereon and extending along the exterior of the one side wall 98 of the primary chute 82.

The second diverter structure 30 of the diverting apparatus 12 at an infeed side thereof is provided in flow communication with the discharge side of the first diverter structure 28 and at a discharge side thereof is provided in flow communication with respective infeed sides of the sheller 18 and the roller mill 20. The second diverter structure 30 includes a pair of downstream tertiary chute portions 104,106 and a second gate 108 disposed between and above the tertiary chute portions. The tertiary chute portions 104,106 also rectangular in cross section are connected to the right upstream secondary chute portion 86. The pair of tertiary chute portions 104,106 define a respective pair of tertiary passages 110,112 branching in flow communication from the corresponding one of the secondary passages 94 of the first diverter structure 28 and extending generally upstream of the tertiary passages 110,112 and the second gate 108.

The second gate 108 of the second diverter structure 30 can be manually shifted selectively to either one of third or fourth displaced positions (respectively shown in solid and dashed line forms in FIG. 7) for respectively providing flow communication through the second diverter structure 30 from the discharge side of the first diverter structure 28 to the infeed side of the roller mill 20 or to the infeed side of the sheller 18. In particular, the second gate 108 is mounted for pivotal movement across the one secondary passage 94 to block one and open the other of the tertiary passages 110,112 when pivotally moved to its third displaced position (seen in solid line form in FIG. 7) and to open the one and block the other of the tertiary passages 110,112 when pivotally moved to its fourth displaced position (seen in dashed line form in FIG. 7).

Figure 7:
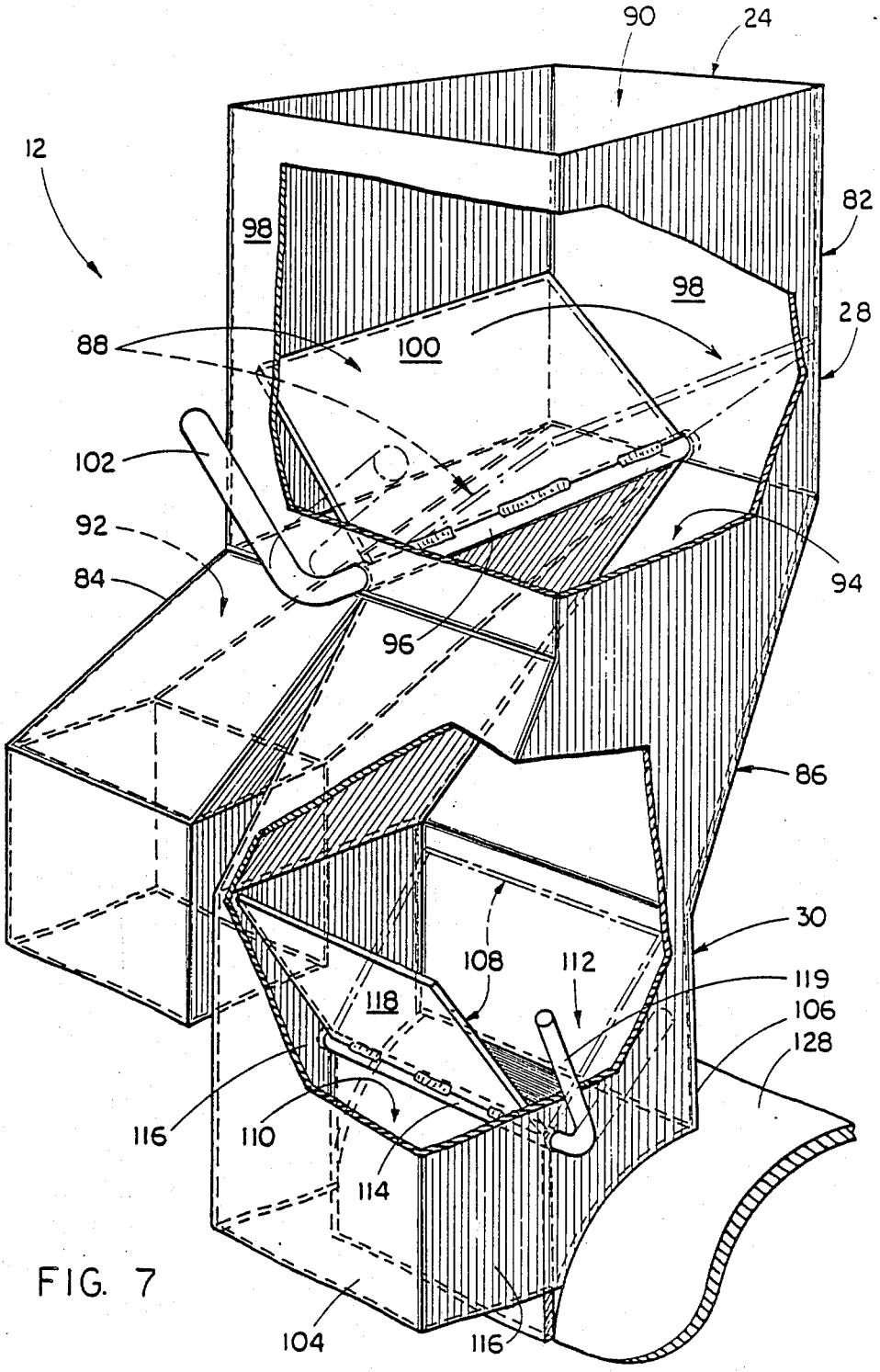
FIG. 7 is an enlarged fragmentary perspective view, with portions broken away, of the machine showing a pair of diverter structures of the apparatus of the present invention.

The second gate 108 of the second diverter structure 30 includes a second rod-like shaft 114 rotatably mounted across the middle of the one secondary chute portion 86 between an opposing pair of the side walls 116 thereof adjacent to and between the tertiary chute portions 104,106. Also, the second gate 108 includes a second plate-like flap 118 attached along the second shaft 114 and extending therefrom within the correspond one secondary passage 94. The second shaft 114 has an upturned handle 119 fixed thereon and extending along the exterior of the one side wall 116 of the one secondary chute 86. As can be seen in FIG. 7, the second shaft 114 of the second gate 108 extends in generally transverse or orthogonal relation to the first shaft 96 of the first gate 88.

Figure 8:
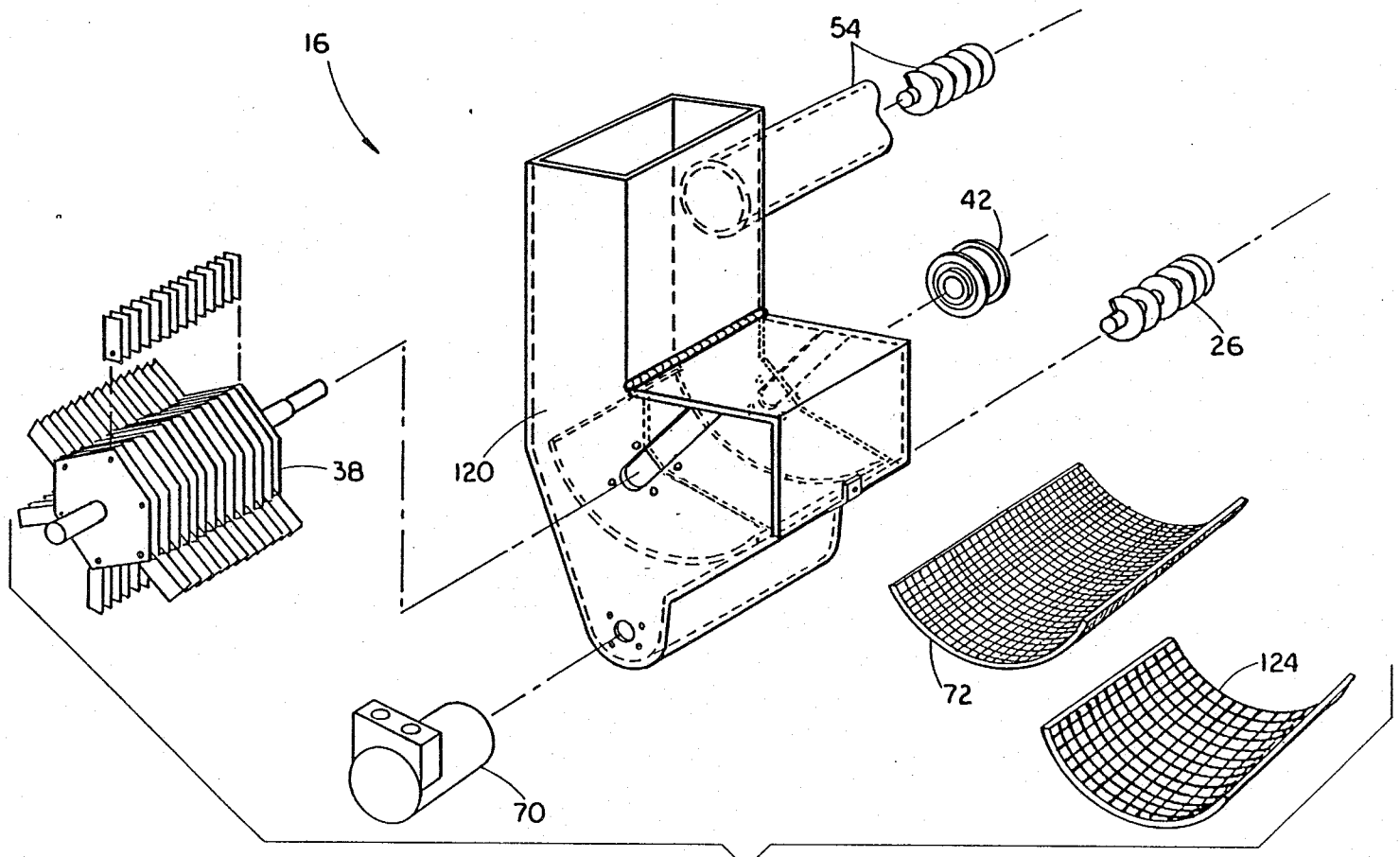
FIG. 8 is an enlarged exploded perspective view of the hammermill of the machine.

Several other features of the present invention relate to the adjustability of the hammermill 16 and the roller mill 20 of the machine 10 for adapting them respectively to vary the particle size of the feed material produced and to process different feed material differently. As seen in FIG. 8, the hammermill 16 includes the rotatable hammerbearing rotor 38 mounted within a housing 120. The top of the housing 120 is connected to the one secondary chute portion 84 in flow communication with the corresponding secondary passage 92 thereof. Also, the hammermill housing 120 is interconnected in flow communication with the discharge side of the sheller 18 via the transfer auger 54 and a rotatable paddle wheel 122 on the sheller shaft 46. The particle size of processed feed material produced by the hammermill 16 can be adjusted by interchanging either one of the screens 72, 124, which have different size perforations, for the other.

Figure 9:
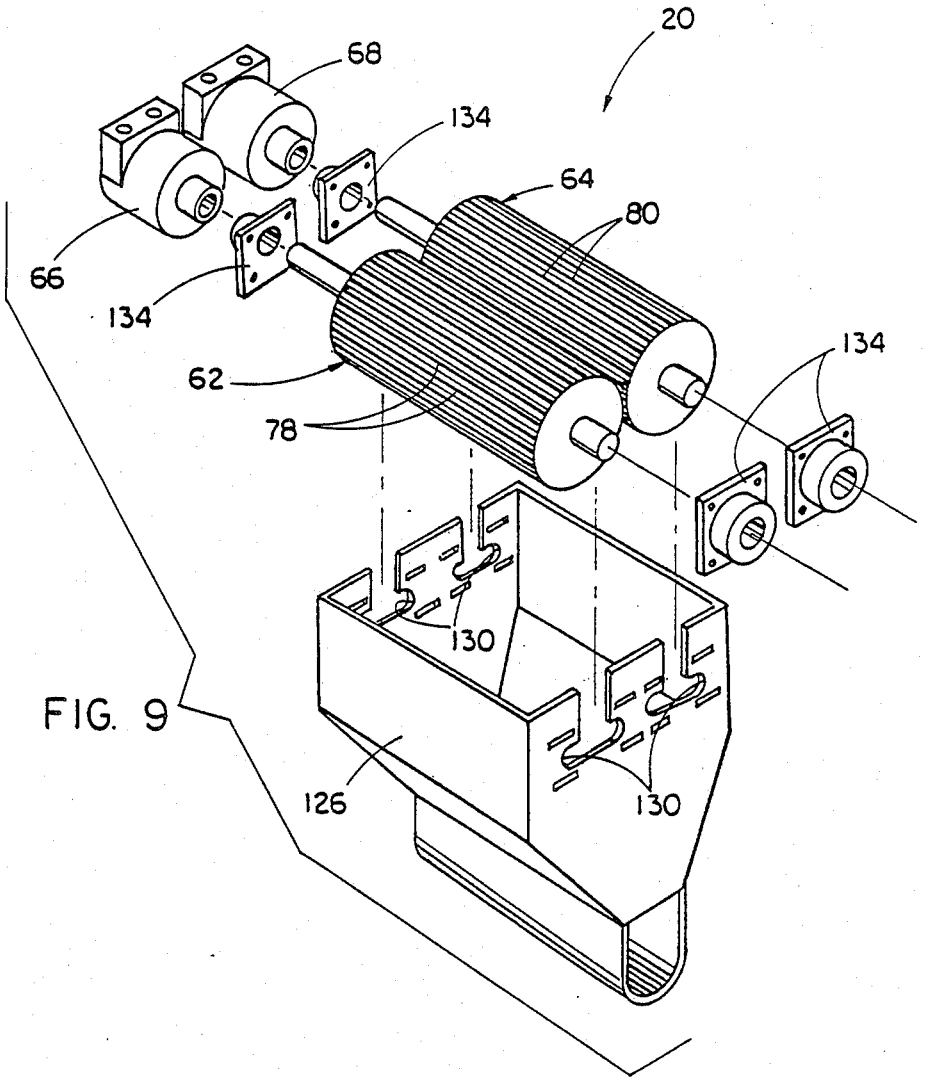
FIG. 9 is an enlarged exploded perspective view of the roller mill of the machine.
Figure 10:
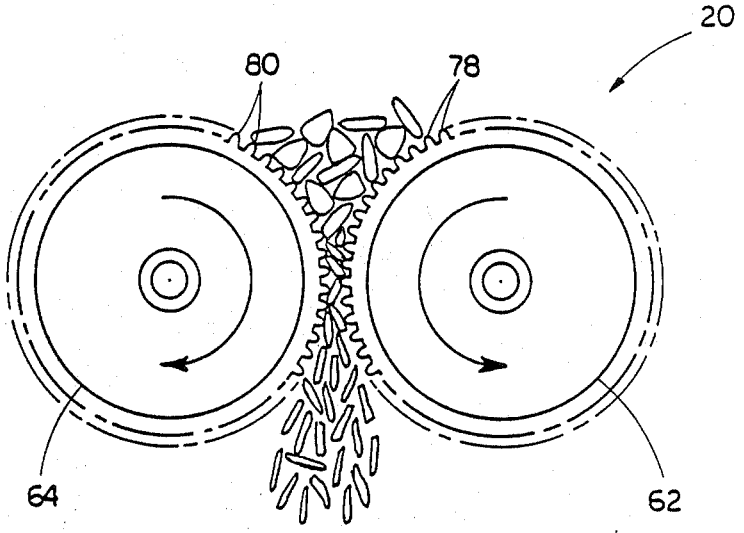
FIGS. 10 and 11 are schematic representations of two different spacing and rotational speed arrangements of the rolls of the roller mill of the machine.
Figure 11:
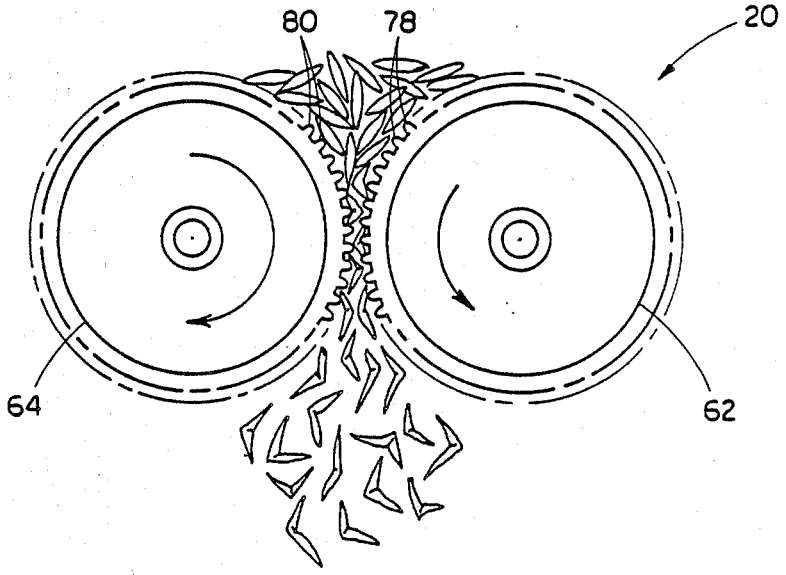

Referring now to FIG. 9, the roller mill 20 includes the pair of counterrotating rolls 62,64 which are mounted in a housing 126 located below a housing 128 of the sheller 18. The housing 126 of the roller mill 20 has slots 130 defined in its opposite end walls 132 through which the opposite ends of the rolls 62,64 are mounted by transversely adjustable couplers 134. The rolls 62,64 are thus movable in their relative positions to adjustably set the spacing between the rolls for either cracking corn kernels or crimping grains of oats. For example, in FIG. 10 there is illustrated a spacing of approximately one-eighth inch for cracking corn kernels. In FIG. 11, there is, illustrated a spacing of approximately one-sixteenth inch for crimping grains of oats. The serrations 78,80 on the rolls 62,64 do not intermesh with one another in either setting of the rolls. Also, in the cracking operation, the corn kernels are broken into several smaller pieces as depicted in FIG. 10. On the other hand, in the crimping operation, the grains of oats are not broken into multiple pieces as depicted in FIG. 11.

The counterrotating rolls 62,64 are also adjustable in their rotational speeds to set the rolls for either cracking corn kernels or crimping grains of oats. Specifically, the hydraulic motors 66,68 coupled to the respective rolls 62,64 are adjustable in speed for driving the rolls at different speeds and independently of one another. For cracking corn kernels, the hydraulic motors 66,68 drive the rolls 62,64 at the same speed. For crimping oats, the hydraulic motors 66,68 drive the rolls 62,64 at different speeds.

In summary, it should be understood that both the first and second gates 88,108 can be pivotally shifted to either of their respective displaced positions to provide flow communication through the first and second diverter structures 28,30 so as to establish the desired flow paths for feed material through the processing machine 10.

It is thought that the present invention and many of its attendant advantages will be understood from the foregoing description and it will be apparent that various changes may be made in the steps of the method, and the form, construction and arrangements of the parts of the apparatus, described without departing from the spirit and scope of the invention or sacrificing all of its material advantages, the form hereinbefore described being merely a preferred or exemplary embodiment thereof.

We claim:

1. In a machine having an inlet, multiple processing mechanisms for performing multiple feed material processing operations, and a discharge mechanism disposed in flow communication with said processing mechanisms, said processing mechanisms including a hammermill for performing a grinding operation, a sheller for performing a separating operation and a roller mill for performing a rolling operation, a method of selecting between said multiple feed material processing operations, said method comprising the steps of:

(a) providing flow communication from said machine inlet to an infeed side of a first diverter structure and from a discharge side of said first diverter structure to an infeed side of said hammermill;

(b) providing flow communication from said discharge side of said first diverter structure to an infeed side of a second diverter structure and from a discharge side of said second diverter structure to respective infeed sides of said sheller and said roller mill;

(c) selectively shifting a first gate of said first diverter structure to either one of first or second displaced positions for respectively providing flow communication through said first diverter structure from said machine inlet to said infeed side of said hammermill or to said infeed side of said second diverter structure; and (d) selectively shifting a second gate of said second diverter structure to either one of third or fourth displaced positions for respectively providing flow communication through said second diverter structure from said discharge side of said first diverter structure to said infeed side of said sheller or to said infeed side of said roller mill.

2. In a machine having an inlet, multiple processing mechanisms for performing multiple feed material processing operations, and a discharge mechanism disposed in flow communication with said processing mechanisms, said processing mechanism including a hammermill for performing a grinding operation, a sheller for performing a separating operation and a roller mill for performing a rolling operation, an apparatus for selecting between said multiple feed material processing operations, said apparatus comprising:

(a) a first diverter structure at an infeed side thereof being disposed in flow communication with said machine inlet and at a discharge side thereof being disposed in flow communication with an infeed side of said hammermill; and (b) a second diverter structure at an infeed side thereof being disposed in flow communication with said discharge side of said first diverter structure and at a discharge side thereof being disposed in flow communication with respective infeed sides of said sheller and said roller mill;

(c) said first diverter structure including a first gate shiftable selectively to either one of first or second displaced positions for respectively providing flow communication through said first diverter structure from said machine inlet to said infeed side of said hammermill or to said infeed side of said second diverter structure;

(d) said second diverter structure including a second gate shiftable selectively to either one of third or fourth displaced positions for respectively providing flow communication through said second diverter structure from said discharge side of said first diverter structure to said infeed side of said sheller or to said infeed side of said roller mill.

3. The machine as recited in claim 1, wherein said hammermill includes a rotatable rotor and a plurality of screens interchangeable with one another and cooperable with said rotor for adapting the hammermill to produce processed feed material of different particle sizes.

4. The machine as recited in claim 1, wherein said roller mill includes a pair of counterrotating rolls that are adjustable in their relative positions to set the spacing between said rolls for either cracking corn kernels or crimping grains of oats.

5. The machine as recited in claim 1, wherein said roller mill includes a pair of counterrotating rolls that are adjustable in their rotational speeds to set said rolls for either cracking corn kernels or crimping grains of oats.

6. The machine as recited in claim 5, wherein said roller mill includes a pair of variable speed hydraulic motors coupled to said respective pair of rolls for driving said rolls at different speeds and independently of one another.

7. The machine as recited in claim 1, wherein said roller mill includes a pair of counterrotating rolls that are adjustable in their relative positions and rotational speeds to set the rolls and the spacing therebetween for either cracking corn kernels or crimping grains of oats.

8. The machine as recited in claim 7, wherein said roller mill includes a pair of hydraulic motors coupled to said respective pair of rolls for driving said rolls at different speeds and independently of one another.

9. The machine as recited in claim 1, wherein said first diverter structure further includes:

a primary chute portion defining said machine inlet and a primary passage extending generally upstream of said first gate; and a pair of secondary chute portions connected to said primary chute portion and defining a pair of secondary passages branching in flow communication from said primary passage generally downstream of said first gate.

10. The machine as recited in claim 9, wherein said first gate of said first diverter structure is mounted for pivotal movement across said primary chute portion, said gate being disposed to block one and open the other of said secondary passages when pivotally moved to its first displaced position, said gate being disposed to open said one and block said other of said secondary passages when pivotally moved to its second displaced position.

11. The machine as recited in claim 10, wherein said gate includes:

a shaft rotatably mounted across the middle of said primary chute portion adjacent to and between said secondary chute portions; and a plate-like flap attached along said shaft and extending therefrom within said primary passage.

12. The machine as recited in claim 11, wherein said shaft has a handle fixed thereon and extending along the exterior of said primary chute.

13. The machine as recited in claim 9, wherein said hammermill includes a rotatable rotor and a plurality of screens interchangeable with one another and cooperable with said rotor for adapting the hammermill to produce processed feed material of different particle sizes.

14. The machine as recited in claim 9, wherein said roller mill includes a pair of counterrotating rolls that are adjustable in their relative positions to set the spacing between said rolls for either cracking corn kernels or crimping grains of oats.

15. The machine as recited in claim 9, wherein said roller mill includes a pair of counterrotating rolls that are adjustable in their rotational speeds to set said rolls for either cracking corn kernels or crimping grains of oats.

16. The machine as recited in claim 15, wherein said roller mill includes a pair of hydraulic motors coupled to said respective pair of rolls for driving said rolls at different speeds and independently of one another.

17. The machine as recited in claim 9, wherein said roller mill includes a pair of counterrotating rolls that are adjustable in their relative positions and rotational speeds to set the rolls and the spacing therebetween for either cracking corn kernels or crimping grains of oats.

18. The machine as recited in claim 17, wherein said roller mill includes a pair of hydraulic motors coupled to said respective pair of rolls for driving said rolls at different speeds and independently of one another.

19. The machine as recited in claim 1, wherein said second diverter structure further includes a pair of tertiary chute portions connected to one of said secondary chute portions of said first diverter structure and defining a pair of tertiary passages branching in flow communication from the corresponding one of said secondary passages of said first diverter structure and extending generally downstream of said second gate, said one secondary passage extending generally upstream of said second gate.

20. The machine as recited in claim 19, wherein said second gate of said second diverter structure is mounted for pivotal movement across said one secondary chute portion, said second gate being disposed to block one and open the other of said tertiary passages when pivotally moved to its third displaced position, said second gate being disposed to open said one and block said other of said tertiary passages when pivotally moved to its fourth displaced position.

21. The machine as recited in claim 20, wherein said second gate includes:

a shaft rotatably mounted across the middle of said one secondary chute portion adjacent to and between said tertiary chute portions; and a plate-like flap attached along said shaft and extending therefrom within said correspond one secondary passage.

22. The machine as recited in claim 21, wherein said shaft has a handle fixed thereon and extending along the exterior of said one secondary chute.

23. The machine as recited in claim 19, wherein said hammermill includes a rotatable rotor and a plurality of screens interchangeable with one another and cooperable with said rotor for adapting the hammermill to produce processed feed material of different particle sizes.

24. The machine as recited in claim 19, wherein said roller mill includes a pair of counterrotating rolls that are adjustable in their relative positions to set the spacing between said rolls for either cracking corn kernels or crimping grains of oats.

25. The machine as recited in claim 19, wherein said roller mill includes a pair of counterrotating rolls that are adjustable in their rotational speeds to set said rolls for either cracking corn kernels or crimping grains of oats.

26. The machine as recited in claim 25, wherein said roller mill includes a pair of hydraulic motors coupled to said respective pair of rolls for driving said rolls at different speeds and independently of one another.

27. The machine as recited in claim 19, wherein said roller mill includes a pair of couterrotating rolls that are adjustable in their relative positions and rotational speeds to set the rolls and the spacing therebetween for either cracking corn kernels or crimping grains of oats.

28. The machine as recited in claim 27, wherein said roller mill includes a pair of hydraulic motors coupled to said respective pair of rolls for driving said rolls at different speeds and independently of one another.

29. In a machine having an inlet, multiple processing mechanisms for performing multiple feed material processing operations and a discharge mechanism disposed in flow communication with said processing mechanisms, said processing mechanism including a hammermill for performing a grinding operation, a sheller for performing a separating operation and a roller mill for performing a rolling operation, an apparatus for selecting between said multiple feed material processing operations, said apparatus comprising:

(a) a first diverter structure at an infeed side thereof being disposed in flow communication with said machine inlet and at a discharge side thereof being disposed in flow communication with an infeed side of said hammermill; and (b) a second diverter structure at an infeed side thereof being disposed in flow communication with said discharge side of said first diverter structure and at a discharge side thereof being disposed in flow communication with respective infeed sides of said sheller and said roller mill;

(c) said first diverter structure including a first gate shiftable selectively to either one of first or second displaced positions for respectively providing flow communication through said first diverter structure from said machine inlet to said infeed side of said hammermill or to said infeed side of said second diverter structure;

(d) said second diverter structure including a second gate shiftable selectively to either one of third or fourth displaced positions for respectively providing flow communication through said second diverter structure from said discharge side of said first diverter structure to said infeed side of said sheller or to said infeed side of said roller mill;

(e) said first diverter structure further including a primary chute portion defining said machine inlet and a primary passage extending generally upstream of said first gate, and a pair of secondary chute portions defining a pair of secondary passages branching in flow communication from said primary passage generally downstream of said first gate, said first gate being mounted for pivotal movement across said primary chute portion to block one and open the other of said secondary passages when pivotally moved to its first displaced position and to open said one and block said other of said secondary passages when pivotally moved to its second displaced position;

(f) said second diverter structure further including a pair of tertiary chute portions connected to one of said secondary chutes of said first diverter structure and defining a pair of tertiary passages branching in flow communication from the corresponding one of said secondary passages of said first diverter structure and extending generally downstream of said second gate, said one secondary passage extending generally upstream of said second gate, said second gate being mounted for pivotal movement across said one secondary chute portion to block one and open the other of said tertiary passages when pivotally moved to its third displaced position and to open said one and block said other of said tertiary passages when pivotally moved to its fourth displaced position.

30. The machine as recited in claim 29, wherein said first gate includes:

a first shaft rotatably mounted across the middle of said primary chute portion adjacent to and between said secondary chute portions; and a first plate-like flap attached along said first shaft and extending therefrom within said primary passage.

31. The machine as recited in claim 30, wherein said first shaft has a handle fixed thereon and extending along the exterior of said primary chute.

32. The machine as recited in claim 30, wherein said second gate includes:

a second shaft rotatably mounted across the middle of said one secondary chute portion adjacent to and between said tertiary chute portions; and a second plate-like flap attached along said second shaft and extending therefrom within said correspond one secondary passage.

33. The machine as recited in claim 32, wherein said second shaft has a handle fixed thereon and extending along the exterior of said one secondary chute.

34. The machine as recited in claim 32, wherein said second shaft of said second gate extends in generally transverse relation to said first shaft of said first gate.

* * * * *